United States Patent [19]

Bessay

[11] Patent Number: 4,832,567

[45] Date of Patent: May 23, 1989

[54] TURBINE STAGE

[75] Inventor: Raymond Bessay, Belfort, France

[73] Assignee: Alsthom-Atlantique, Paris, France

[21] Appl. No.: 214,992

[22] Filed: Jul. 1, 1988

Related U.S. Application Data

[62] Division of Ser. No. 414,253, filed as PCT FR81/00172 on Dec. 30, 1981, published as W082/02418 on Jul. 22, 1982, Pat. No. 4,778,338.

[30] Foreign Application Priority Data

Jan. 5, 1981 [FR] France ..... 81 00039

[51] Int. Cl.[4] ..... F01D 9/04

[52] U.S. Cl. ..... 415/181; 415/914

[58] Field of Search ..... 415/181, 198.1, 199.4, 415/199.5, 53 R, DIG. 1, 216, 217; 416/223 A, DIG. 2

[56] References Cited

U.S. PATENT DOCUMENTS

| | | | |
|---|---|---|---|
| 1,632,907 | 6/1927 | Losel | 415/185 |
| 2,846,137 | 8/1958 | Smith, Jr. | 415/DIG. 1 |
| 4,365,932 | 12/1982 | Arnaudeau | 415/199.5 |
| 4,371,311 | 2/1983 | Walsh | 415/199.5 |
| 4,460,309 | 7/1984 | Walsh | 415/199.5 |
| 4,778,338 | 10/1988 | Bessay | 415/181 |

FOREIGN PATENT DOCUMENTS

| | | | |
|---|---|---|---|
| 613424 | 1/1961 | Canada | 415/181 |

*Primary Examiner*—Robert E. Garrett
*Assistant Examiner*—John T. Kwon
*Attorney, Agent, or Firm*—Sughrue, Mion, Zinn, Macpeak & Seas

[57] ABSTRACT

A turbine stage which has a stationary blade set (204) followed by a moving blade set (205) which have blades (206, 207) mounted between a floor plate (201, 211) and a ceiling plate (202, 212). The surfaces of the ceiling plate (202, 212) and/or of the floor plate (201, 211) have as their meridian lines sinusoids with the maximum for the ceiling plate (202, 212) and the maximum or the minimum for the floor plate (201, 211) located in the plane between the blade sets. The curvature of the sinusoid at the outlet end of the stationary blade set (204) is calculated so as to make the tangential static pressure gradient equal to the radial static pressure gradient at the ceiling plate and/or at the floor plate equal at the outlet end of the stationary blade set (204). The disturbances are confined to restricted zones and the efficiency of the stage is thereby improved.

6 Claims, 6 Drawing Sheets

TURBINE STAGE

This is a division of application Ser. No. 414,253 filed as PCT FR81/00172 on Dec. 30, 1981, published as W082/02418 on Jul. 22, 1982, now U.S. Pat. No. 4,778,338.

FIELD OF THE INVENTION

The present invention relates to a turbine stage which has a stationary circular blade set followed by a moving circular blade set, each set having blades assembled between a floor plate and ceiling plate.

The succession of blades thus formed therefore defines a group of passages along which a fluid flows, each passage being delimited by two consecutive blades and by the floor plate and the ceiling plate.

BACKGROUND OF THE INVENTION

It is known that in a given passage, at points which are sufficiently far from the walls of the passage, the stream lines follow paths which are substantially parallel to the walls of the passage formed by the concave and convex surfaces of the blades.

At all points along the path, the centrifugal force which is exerted on a particle is balanced by the pressure forces. The result of this is, generally, that the concave surface of the blade is subjected to a higher pressure than is the convex surface.

It is also known that in the boundary layer near the floor plate and ceiling plate, the speed of the fluid is low. It follows that since the pressure forces are no longer balanced, the stream lines are curves perpendicular to the isobars and follow paths of considerable slippage in each passage from the concave surface to the convex surface as is well known to the person skilled in the art (FIG. 1).

The slippage generates a counterclockwise eddy against the ceiling plate of the passage and a clockwise eddy against the floor plate as seen by an observer placed downstream from the set of blades of FIG. 1.

These disturbances cause important losses known as secondary losses and the smaller the ratio between the height of the blades and the chord, the more the efficiency of a set of blades is reduced.

It has been observed that in the case of a stationary circular set of blades, the effect of the radial static pressure gradient which develops at the outlet end when the meridian line of flow is cylindrical, conical or slightly curved adds to the phenomenon described hereinabove.

This gradient results from the centrifugal acceleration due to the peripheral component of the absolute speed at the outlet end of the blade set and increases the secondary eddy at the upper contour of the flow stream and reduces it at the lower contour thereof (FIG. 2) since the static pressure increases radially from the bottom of the blade set to the top of the blade set.

The variation in the static pressure in the plane between blade sets as a function of the radius is represented by a solid-line curve which continually increases as shown in FIG. 3.

The slope of the curve at the bottom and at the top is equal to:

$$\frac{dp}{dr} = \rho \frac{V_u^2}{r} \quad (1)$$

p: Static pressure in the plane between blade sets.

r: Radius.

$\rho$: Density of the fluid.

$V_u$: Tangential component of the absolute fluid speed in the plane between blade sets.

The direction of radial variation of the static pressure which decreases from the ceiling plate to the floor plate amplifies the secondary eddy at the ceiling plate and opposes the secondary eddy at the floor plate, as illustrated in FIG. 2.

In the conventional case of a passage with a floor plate and a ceiling plate, the radial gradient of the static pressure in the plane between blade sets is detrimental at the ceiling plate and favourable at the floor plate. This does not mean, however, that the absolute value of the radial gradient of the static pressure at the floor plate is the best for minimizing the secondary losses.

The invention relates to a turbine stage with a circular stationary blade set followed by a circular moving blade set, each blade set having blades mounted between a floor plate and a ceiling plate which are radially symmetrical about a turbine shaft, the pitch of the stationary blades being $L_S$ at the ceiling plate and $L_B$ at the floor plate and the outlet angle of the stream of fluid from the stationary blade set relative to the plane between said blade sets being $\alpha 1_S$ adjacent to the ceiling plate and $\alpha 1_B$ adjacent to the floor plate, in which stage the distance between the turbine shaft and the surface of the ceiling plate decreases when going from the inlet end of the stationary blade set to the outlet end of the stationary blade set where its value is $r_S$ and then increases going from the inlet end of the moving blade set where its value is $r_S$ up to the outlet end of the moving blade set.

Such a turbine stage is disclosed in British Pat. No. 596 784.

In the stage described in said British patent, the curve of the floor plate and of the ceiling plate is calculated to provide constant pressure in the plane between the blades sets (at the outlet end of the stationary blade set) from the top to the bottom of said space, i.e. the constant radial static pressure gradient is zero.

In the turbine stage in accordance with the invention, the central curve of the ceiling plate at the plane between the blade sets is substantially equal to $$-\frac{\cot^2\alpha_{1S}}{r_S} - \frac{\cos\alpha_{1S}}{4L_S\sin^2\alpha_{1S}}$$

Thus, in the neighbourhood of the ceiling plate, the radial static pressure gradient is equal to the tangential static pressure gradient between the blades sets. This confines the disturbed zone at the ceiling plate to a relatively small flow cross-section.

This invention also relates to a turbine stage with a circular stationary blade set followed by a circular moving blade set having blades mounted between a floor plate and a ceiling plate which are radially symmetrical about a turbine shaft, the pitch of the stationary blades being $L_S$ at the ceiling plate and $L_B$ at the floor plate and the outlet angle of the stream of fluid from the stationary blade set relative to the plane between said blade sets being $\alpha 1_S$ adjacent to the ceiling plate and $\alpha 1_B$ adjacent to the floor plate, in which stage the distance between the turbine shaft and the surface of the floor plate varies continuously from the inlet end of the stationary blade set to the outlet end of said stationary blade set where it reaches a extreme value $r_B$ then varies continuously in the opposite direction from the inlet of the moving blade set where its value is $r_B$ up to the outlet of the moving blade set.

Said turbine stage is also described in British Pat. No. 596 784.

SUMMARY OF THE INVENTION

In the turbine stage in accordance with the invention, the central curve of the floor plate of the stationary blade set at the plane between the blade sets is substantially equal to the difference $$\frac{\cos\alpha_{1B}}{4L_B\sin^2\alpha_{1B}} - \frac{\cot^2\alpha_{1B}}{r_B}$$

the extreme value $r_B$ being a minimum when the difference is negative and a maximum when the difference is positive.

Therefore, in the neighbourhood of the floor plate, the radial static pressure gradient in the plane between the blade sets is not zero as it is in the British patent, but is equal to the tangential static pressure gradient in the plane between the blade sets. This confines the disturbed zone at the floor plate to a relatively small flow cross-section.

Obviously, in accordance with the invention, the shape at the ceiling plate can be combined with the shape at the floor plate so as to confine the disturbed zone at both the ceiling plate and at the floor plate to relatively small flow cross-sections.

According to a first variant of the invention, when means are provided to reduce the tangential static pressure gradient in the neighbourhood of the ceiling plate at the outlet end of the stationary blade set by a factor $\lambda(\lambda>1)$ and the curvature of the meridian line of the ceiling plate of the stationary blade set perpendicular to the plane between the blade sets is substantially equal to $$-\frac{\cot^2\alpha_{1S}}{r_S} - \frac{1}{\lambda}\,\frac{\cos\alpha_{1S}}{4L_S\sin^2\alpha_{1S}}$$

Therefore, in the neighbourhood of the ceiling plate, at the outlet end of the stationary set of blades, the radial static pressure gradient is kept equal to the tangential static pressure.

According to a second variant of the invention, when means are provided to reduce the tangential static pressure gradient in the neighbourhood of the floor plate at the outlet end of the stationary blade set by a factor $\lambda'(\lambda'>1)$ and the curvature of the meridian line of the floor plate of the stationary blade set perpendicular to the plane between the blade sets is substantially equal to $$\frac{1}{\lambda^1}\,\frac{\cos\alpha_{1B}}{4L_B\sin^2\alpha_{1B}} - \frac{\cot^2\alpha_{1B}}{r_B}$$

the extreme value $r_B$ being a minimum when the difference is negative and a maximum when the difference is positive. Therefore, in the neighbourhood of the floor plate, at the outlet end of the stationary blade set, the radial static pressure gradient is kept equal to the tangential static pressure.

In accordance with a preferred embodiment of the invention these two variants of the turbine stage are combined. This allows firstly the intensity of the eddies at the ceiling and floor plates to be reduced and secondly the eddies to be confined to a narrow zone.

Preferably, the distance between the turbine shaft and the surface of the ceiling plate of the stationary blade set varies in a curve which has a maximum at the inlet end of the stationary blade set and at the outlet and of the moving blade set and a minimum in the plane between the blade sets.

Likewise, the distance which separates the turbine shaft from the surface of the floor plate follows a curve which has:

either a maximum in the plane between the sets of blades which maximum is associated with a minimum at the inlet end of the stationary blade set and at the outlet end of the moving blade set;

or a minimum in the plane between the blade sets which minimum is associated with a maximum at the inlet end of the stationary blade set and at the outlet end of the moving blade set.

However, manufacture can be facilitated by replacing the curved meridian lines of the ceiling and/or floor plates of the moving blade set by straight line segments.

Embodiments of the present invention are described by way of example with reference to the accompanying drawings.

DESCRIPTION OF THE PREFERRED EMBODIMENTS

Figure 1:
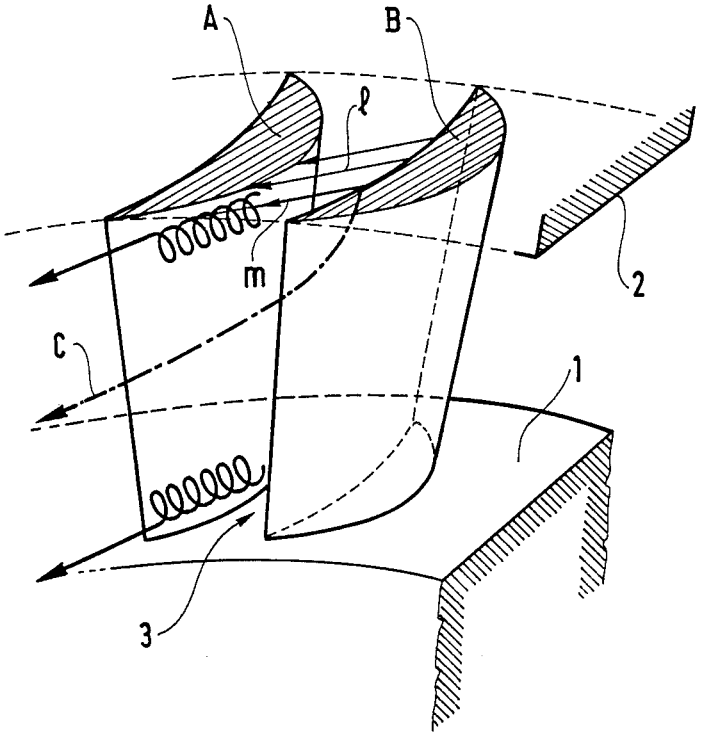
FIGS. 1 and 2 illustrate part of a stationary blade set of a conventional turbine stage.

In FIG. 1, two blades A and B form part of a stationary set of blades. Their roots are fixed to a floor plate 1 and their heads are fixed to a ceiling plate 2. Said floor and ceiling plates are usually co-axial, cylindrical or frustoconical members.

The concave surface of the blade B, the convex surface of the blade A, the floor plate 1 and the ceiling plate 2 define a passage 3.

Fluid far from the walls of the passage flows smoothly along streamlines such as (c). In contrast, stream lines of fluid which come into contact with the ceiling plate and the floor plate are orthogonal to the isobars and flow in the directions shown (l) and (m), then begin to be turbulent as soon as they strike the convex surface of the blade (A).

Figure 2:
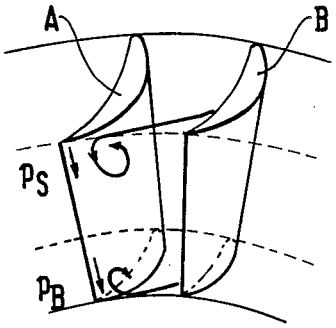

FIG. 2 shows the static pressure at the outlet from the stationary set of blades. In the neighbourhood of the ceiling plate the static pressure is $p_S$ and in the neighbourhood of the floor plate it is $p_B$.

The pressure $p_S$ is higher than the pressure $p_B$ so that in the neighbourhood of the ceiling plate, the secondary turbulence is amplified while it is damped in the neighbourhood of the floor plate.

The static pressure decreases constantly from the ceiling plate to the floor plate.

Figure 3:
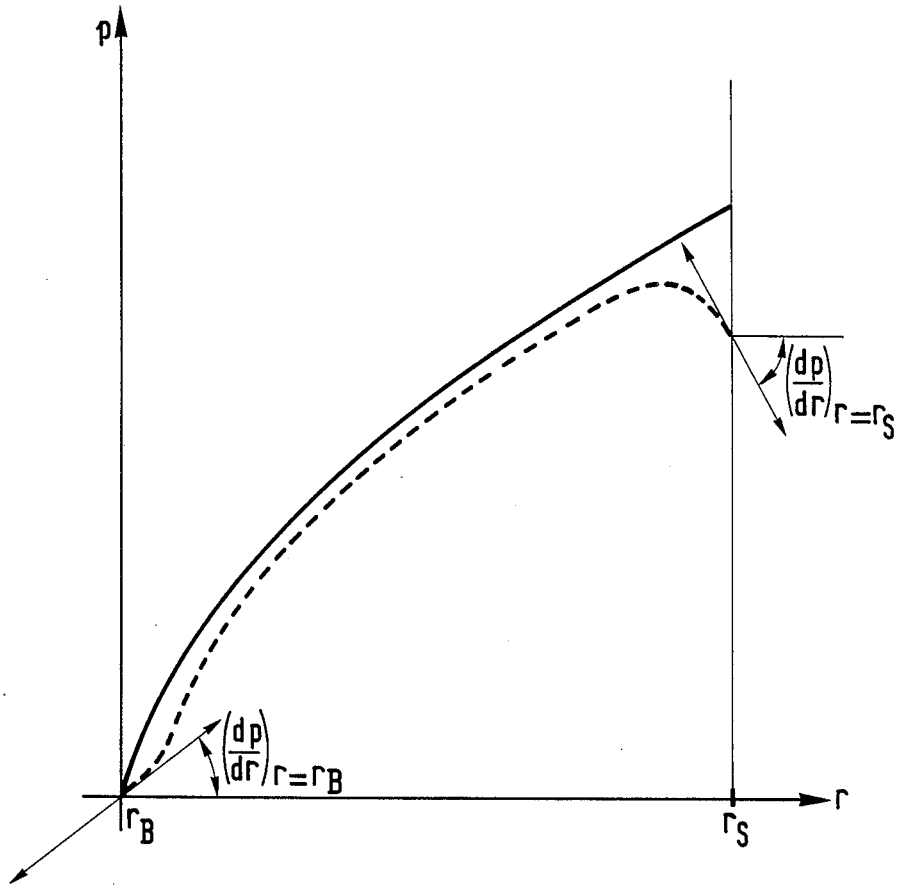
FIG. 3 illustrates the curves of pressure variation in the plane between the blade sets as a function of distance r from the shaft.

The radial static pressure between adjacent blade sets in a conventional turbine is shown schematically in FIG. 3 by the solid-line curve which goes from $r_B$ representing the radius of the floor plate in the plane between the blade sets to $r_S$ representing the radius of the ceiling plate in the same plane. The dashed line shows the desired curve.

Figure 4:
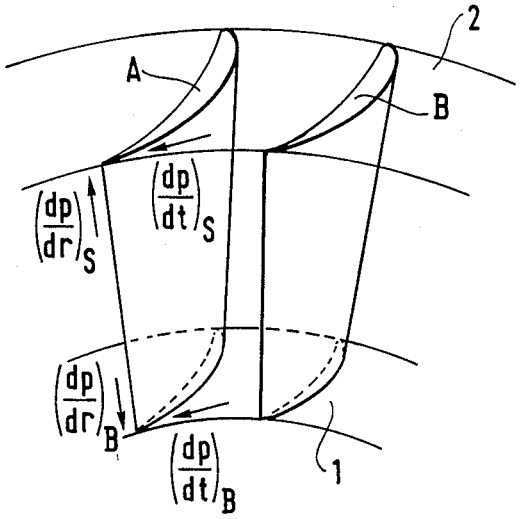
FIG. 4 schematically illustrates a set of stationary blades of a turbine stage in accordance with the invention.

FIG. 4 shows the result to be obtained at the outlet end of a stationary blade set.

To confine the disturbed zone to a relatively small flow path cross-section at the ceiling plate and/or at the floor plate it is necessary to equalize the absolute values of the tangential static pressure gradient (dp/dt) and of the radial static pressure gradient (dp/dr) at the ceiling plate and/or at the floor plate at the outlet end of the stationary blade set.

Therefore, arrangements must be made such that, at the ceiling plate.

$$\left(\frac{dp}{dt}\right)S = \left(\frac{dp}{dr}\right)S$$

while at the floor plate $$\left(\frac{dp}{dt}\right)B = \left(\frac{dp}{dr}\right)B$$

where (dp/dr) S from the floor plate to the ceiling plate while (dp/dr) B from the ceiling plate to the floor plate.

To produce this effect, the meridian line of the ceiling plate and/or of the floor plate of the stationary blade set must be curved in a radial plane.

Figure 5:
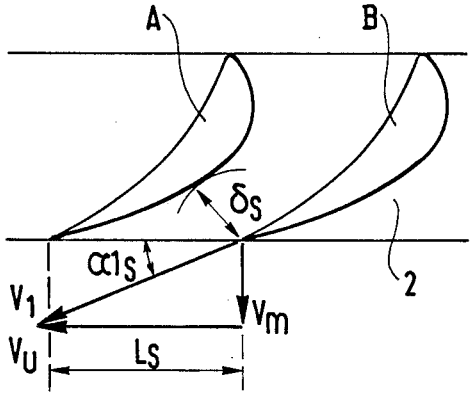
FIG. 5 illustrates a cross-section at the ceiling plate of a set of stationary turbine blades according to FIG. 4.

FIG. 5 is a cylindrical cross-section through the tops of blades A and B of a stationary blade set.

Angle $\alpha_{1S}$ is the stream injection angle (into the following moving blade set) relative to the blade tip line on the ceiling plate; $V_l$ is the absolute speed between the blade sets; $V_u$ is the tangential component of the absolute speed between the blade sets; and $V_m$ is the axial component of the absolute speed between the blade sets in the meridian plane.

$L_S$ is the pitch of the blades at the ceiling plate; the angle $\alpha_{1S}$ can very easily be calculated from the equation $\sin \alpha_{1S}=(\delta S/L_S)$ ($\delta_S$ being the width of the constriction between the blades A and B in the neighbourhood of the ceiling plate).

Figure 6:
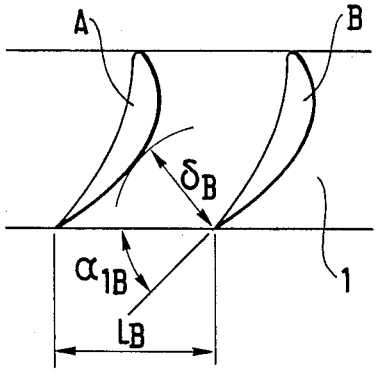
FIG. 6 illustrates a cross-section at the floor plate of a stationary blade set according to FIG. 4.

FIG. 6 is a cylindrical cross-section through the roots of blades A and B of a stationary blade set.

Angle $\alpha_{1B}$ is the stream injection angle (into the following moving blade set) relative to the exit plane of the stationary blade set.

The pitch of the blades A and B at the floor plate is $L_B$; the width of the constriction is $\delta_B$; the angle $\alpha_{1B}$ can very easily be calculated from the equation $$\sin\alpha_{1B} = \frac{\delta B}{L_B}.$$

Here, now, are the calculations of the radii of curvature to be imparted to the curved meridian lines of the ceiling and floor plates at the outlet from the stationary blade set (i.e. in the plane between the blade sets).

The radial static pressure gradient between the blade sets is determined by the following equation:

$$\frac{dp}{dr} \simeq \rho\frac{V_u^2}{r} + \rho\frac{V_m^2}{R} \tag{2}$$

where $V_m$ is the absolute speed between the blades in the meridian plane and 1/R is the curvature of the meridian fluid stream lines.

p, r, $\rho$ and $V_u$ have the same meanings as in equation (1).

R is negative in equation (2) when the meridian lines deviate towards the turbine shaft; otherwise R is positive.

Now, it is known that $$\frac{dp}{dt} \approx \frac{1}{2}\ \frac{\Delta p}{L/cos\alpha_1} \tag{3}$$

where $\alpha_l$ is the injection angle of the fluid stream relative to the plane between blade sets at radius r and L is the spacing between two consecutive blades at the same radius.

$\frac{1}{2}$ is an experimental coefficient and $\Delta P$ is the pressure drop in the stationary blade set.

Now, in accordance with Bernouilli's theorem $$\Delta P=\tfrac{1}{2}\rho V_l^2 \tag{4}$$

Also, $$V_l^2=V_u^2+V_m^2 \tag{5}$$

By making the value of |dp/dr| equal to that of |dp/dt| we find $$\pm\left(\rho\frac{V_u^2}{r} + \rho\frac{V_m^2}{R}\right) = \frac{1}{2}\cdot\frac{\rho}{2}\ \frac{(V_u^2 + V_m^2)\cdot\cos\alpha_1}{L} \tag{6}$$

with the sign (+) in the case of the floor plate and the sign (−) in the case of the ceiling plate, dividing through by $\rho V_m^2$, we get $$\pm\left(\frac{V_u^2}{V_m^2}\cdot\frac{1}{r} + \frac{1}{R}\right) = \frac{\left(1 + \frac{V_u^2}{V_m^2}\right)\cos\alpha_1}{4L} \tag{7}$$

and since $(V_m/V_u)=\tan\alpha_l$ $$\frac{1}{R} = \pm \frac{\cos\alpha_1}{4L \sin^2\alpha_1} - \frac{\cot^2\alpha_1}{r} \quad (8)$$

Figure 7:
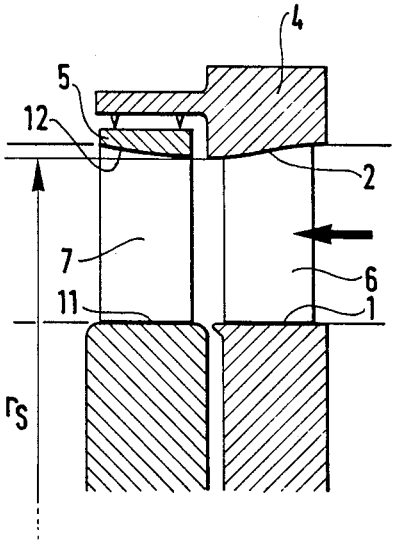
FIG. 7 illustrates a first embodiment of a turbine stage in accordance with the invention.

FIG. 7 is a cross-section through a turbine stage in accordance with the invention in which stage the effect of the secondary losses is minimized in the neighbourhood of the ceiling plate. The fluid, e.g. steam, flows from right to left in the direction of the arrow.

The stage has a stationary blade set 4 followed by a moving blade set 5.

The stationary blade set has blades 6 assembled between a floor plate 1 and a ceiling plate 2.

The moving plate set 5 has blades 7 assembled between a floor plate 11 and a ceiling plate 12.

The ceiling plate 2 of the stationary blade set 4 is a body of revolution about the turbine axis and its meridian line follows one half of a cycle of a sinusoid which gets nearer to the turbine axis when going from the inlet end to the outlet end of the stationary blade set 4.

The ceiling plate 12 of the moving blade set 5 is substantially symmetrical to the ceiling plate 2 relative to the plane between blade sets which is perpendicular to the turbine axis.

The curvature of the meridian line of the ceiling plate in the plane between blade sets is $$\frac{1}{R} = -\frac{\cot^2\alpha_{1S}}{r_S} - \frac{\cos\alpha_{1S}}{4L_S \sin^2\alpha_{1S}}$$

Instead of being in the form of half a cycle of a sinusoid, the meridian line of the ceiling plate 12 could be in the form of an inclined segment of a straight line sloping away from the axis when going from the inlet end to the moving blade set 5, (where the ceiling plate 12 is $r_S$ distant from the turbine axis) towards the outlet end thereof.

In the embodiment illustrated in FIG. 7, the floor plate is that of a conventional turbine.

Figure 8:
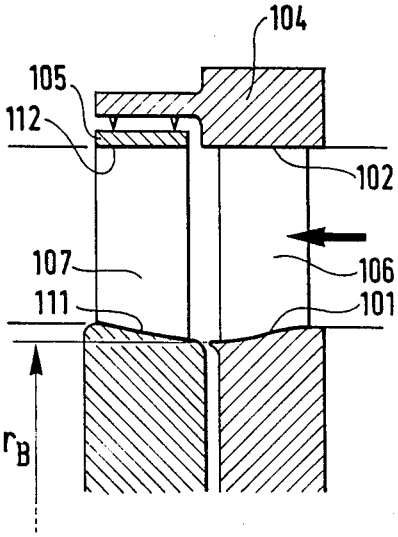
FIG. 8 illustrates a second embodiment of a turbine stage in accordance with the invention.
Figure 9:
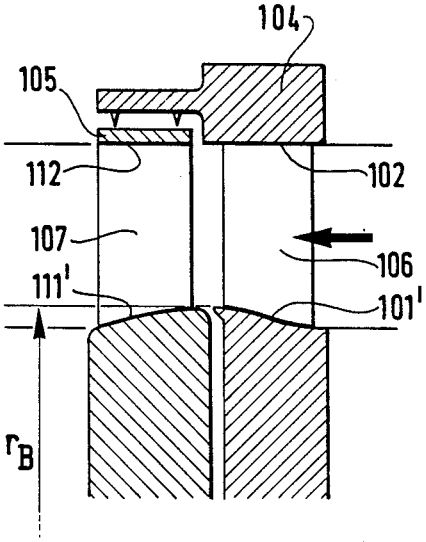
FIG. 9 illustrates a third embodiment of a turbine stage in accordance with the invention.

FIGS. 8 and 9 are a cross-sections through turbine stages in accordance with the invention in which the effect of the secondary losses in the neighbourhood of the floor plate is minimized.

The reference numerals are the same as for FIG. 7 but with 100 added to each reference.

In the case of FIG. 8, the floor plate 101 of the stationary blade set 104 is a body of revolution about the turbine axis and its meridian line is a half cycle of a sinusoid which slopes towards the turbine axis when going from the inlet towards the outlet.

The floor plate 111 of the moving blade set 105 is substantially symmetrical to the lower plate 101 relative to the plane between blade sets.

As in the case of FIG. 7, the sinusoidal shape of the meridian line of the floor plate 111 could be replaced by an inclined straight line sloping away from the turbine axis when going from the inlet end (where it is $r_B$ distant from the turbine axis) towards the outlet end of the moving blade set 105.

The curvature of the floor plate in the plane between blade sets is $$\frac{1}{R} = \frac{\cos\alpha_{1B}}{4L_B \sin^2\alpha_{1B}} - \frac{\cot^2\alpha_{1B}}{r_B}$$

In FIG. 9 the difference between $$\frac{\cos\alpha_{1B}}{4L_B \sin^2\alpha_{1B}} \text{ and } \frac{\cot^2\alpha_{1B}}{r_B}$$

is positive because the meridian line of the floor plate 101' of the stationary blade set 104 is in the form of half a cycle of a sinusoid which slopes away from the axis when going from the inlet end towards the outlet end of the blade set.

The meridian line of the floor plate 111' of the moving blade set 105 is symmetrical to the meridian line of the floor plate 101' relative to the plane between blade sets. A meridian line could also be constituted by a segment of a straight line sloping towards the turbine axis going from the inlet end (where it is $r_B$ distant from the axis) to the outlet end of the moving blade set 105.

The curvature in the plane between blade sets at the floor plate is therefore equal to $$\frac{1}{R} = +\frac{\cos\alpha_{1B}}{4L_B \sin^2\alpha_{1B}} - \frac{\cot^2\alpha_{1B}}{r_B}$$

Figure 10:
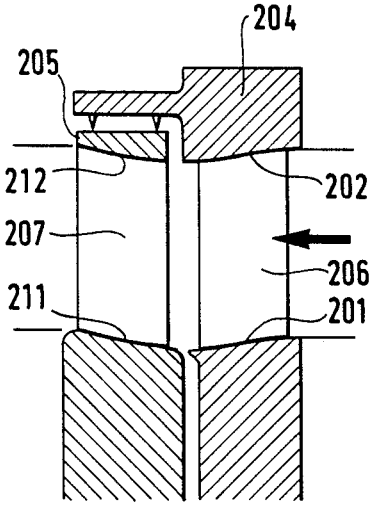
FIG. 10 illustrates a fourth embodiment of a turbine stage in accordance with the invention.

FIG. 10 illustrates a turbine stage in accordance with the invention with a ceiling plate similar to that of the turbine stage in FIG. 7 and a floor plate similar to that of FIG. 8. The reference numerals have 200 added to corresponding numerals of FIG. 7.

Figure 11:
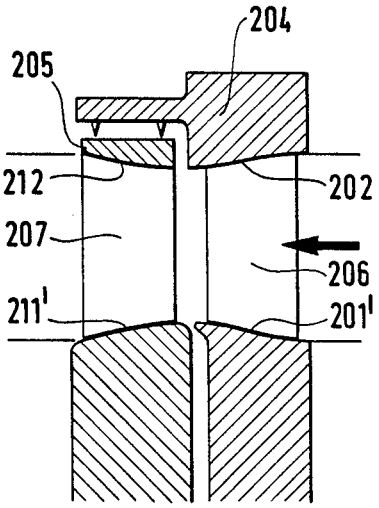
FIG. 11 illustrates a fifth embodiment of a turbine stage in accordance with the invention.

Likewise, FIG. 11 illustrates a turbine stage in accordance with the invention with a ceiling plate like that of the turbine stage of FIG. 7 and a floor plate like that in FIG. 9. The reference numerals have 300 added to corresponding numerals of FIG. 7.

Figure 12:
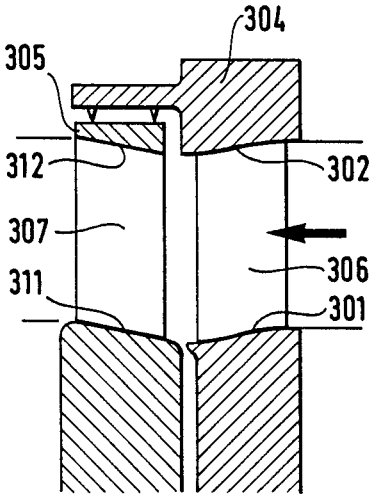
FIGS. 12 and 13 illustrate simplified versions of the embodiments of FIGS. 10 and 11.
Figure 13:
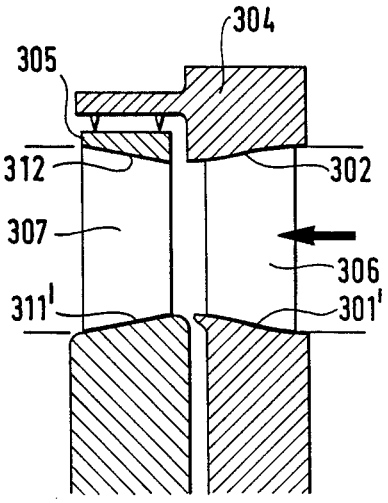

FIGS. 12 and 13 are variants of FIGS. 10 and 11 in which variants the meridian lines of the floor plates 311 and 311' respectively and of the ceiling plate 312 of the moving blade set 305 are straight lines.

Figure 14:
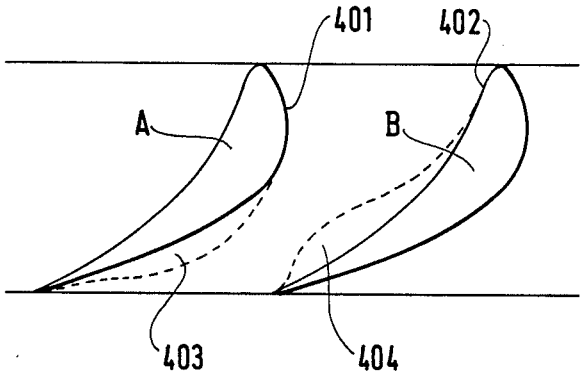
FIGS. 14 and 15 illustrate a modified turbine still in accordance with the invention which turbine has means to reduce the tangential static pressure gradient of a stationary blade set.

FIG. 14 is a cross-section through a stationary blade set taken in a cylindrical surface about the turbine axis, said blade set including means for reducing secondary losses in each of the passages delimited by the convex surface 401 of one blade A and the concave surface 402 of an adjacent blade B. These means are described for example in Belgian Pat. No. 677 969. The floor plate and/or the ceiling plate are hollowed out in the neighbourhood of the convex surface of the blade A (see reference 403). This locally reduces excess pressure perpendiculer to the floor plate and/or to the ceiling plate.

Similarly, matter is added at 402 to the floor plate and/or the ceiling plate in the neighbourhood of the concave surface of the blade B. This locally reduces the pressure perpendicular to the floor plate and/or to the ceiling plate.

This causes a reduction in the pressure difference between the concave surface and the convex surface and therefore reduces the secondary losses.

The inside shape of the stationary blade set also has a periodicity $2\pi/N_D$ radians where $N_D$ is the number of blades in the guide vane. However, in the outlet end plane of the blade set perpendicular to the turbine axis, the set of passages is tangential to a surface of revolution about the turbine axis. In other words, in this outlet end plane, the flow stream returns to being symmetrical about the axis.

These means reduce the tangential static pressure gradient in the neighbourhood of the ceiling plate by a factor $\lambda$ and/or the tangential static pressure gradient in the neighbourhood of the floor plate by a factor $\lambda'$, in both cases at the outlet end of the stationary blade set.

To apply the invention to cases where the tangential gradient is divided by $\lambda$ the following equation is to be applied:

$$\frac{1}{R} = \pm \frac{1}{\lambda} \frac{\cos\alpha_1}{4L \sin^2\alpha_1} - \frac{\cot^2\alpha_1}{r} \quad (9)$$

All the equations calculated for the curvature of the turbine stages illustrated in FIGS. 1 to 13 are valid providing the expression in $$\frac{\cos\alpha_1}{4L \sin^2\alpha_1} \text{ is multiplied by } \frac{1}{\lambda} \left( \text{or } \frac{1}{\lambda'} \right)$$

Figure 15:
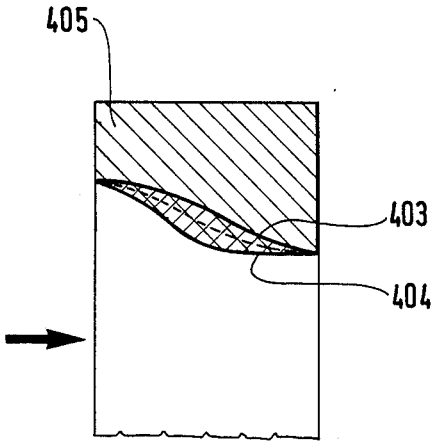

To manufacture such a stationary blade set (FIG. 15) in which dp/dt and dp/dr are reduced, extra parts 405 can be placed on the ceiling plate of the blade set (other extra parts also being fixed to the floor plate). Each extra part 405 has a contour 403 where it meets the convex surface of the blade A and a contour 404 where it meets the concave surface of the blade B. The intermediate contour of the part which could have been used to form the blade sets illustrated in FIGS. 7 to 13 in which no means are provided to reduce the secondary losses in the ratio $\lambda$ or $\lambda'$ is illustrated in a dashed line.

Means other than hollowing out and adding substance can be used to reduce the tangential static pressure gradient and therefore to reduce the secondary losses of a stationary blade set. Such means are described for example in PCT applications published on Apr. 17, 1980 under No. WO 80/00728 and No. WO 80/00729.

I claim:

1. A turbine stage with a circular stationary blade set (4) followed by a circular moving blade set (5), each blade set (4,5) having blades (6,7) mounted between a floor plate (1,11) and a ceiling plate (2,12) which are radially symmetrical about a turbine shaft, the pitch of the stationary blades (6) being $L_S$ at the ceiling plate (2) and $L_B$ at the floor plate (1) and the outlet angle of the stream of fluid from the stationary blade set (4) relative to the plane of said blade sets being $\alpha 1_S$ adjacent to the ceiling plate (2) and $\alpha 1_B$ adjacent to the floor plate (1), in which stage the distance between the turbine shaft and the surface of the ceiling plate (2) decreases when going from the inlet end of the stationary blade set (4) to the outlet end of the stationary blade set (4) where its value is $r_S$ and then increases going from the inlet end of the moving blade set (5) where its value is $r_S$ up to the outlet end of the moving blade set (5), characterized in that the curvature of the meridian line of the ceiling plate (2) of the stationary blade set (4) adjacent to the plane between said blade sets is substantially equal to $$-\frac{\cot^2\alpha_{1S}}{r_S} - \frac{\cos\alpha_{1S}}{4L_S \sin^2\alpha_{1S}}.$$

2. A turbine stage with a circular stationary blade set (104) followed by a circular moving blade set (105) having blades (106,107) mounted between a floor plate and a ceiling plate which are radially symmetrical about a turbine shaft, the pitch of the stationary blades (106) being $L_S$ at the ceiling plate (102) and $L_B$ at the floor plate (101,101') and the outlet angle of the stream of fluid from the stationary blade set (104) relative to the plane between said blade sets (104) being $\alpha 1_S$ adjacent to the ceiling plate (102) and $\alpha 1_B$ adjacent to the floor plate (101,101') in which stage the distance between the turbine shaft and the surface of the floor plate (101,101') varies continuously from the inlet end of the stationary blade set (104) to the outlet end of said stationary blade set (104) where it reaches an extreme value $r_B$ then varies continously in the opposite direction from the inlet of the moving blade set (105) where its value is $r_B$ up to the outlet of the moving blade set (105), characterized in that the curvature of the meridian line of the floor plate (101, 101') of the stationary blade set (101) adjacent the plane between the blade sets is substantially equal to the difference $$\frac{\cos\alpha_{1B}}{4L_B \sin^2\alpha_{1B}} - \frac{\cot^2\alpha_{1B}}{r_B}$$

the extreme value $r_B$ being a minimum when the difference is negative and a maximum when the difference is positive.

3. A turbine stage with a circular stationary blade set followed by a circular moving blade set (5), each blade set (4,5) having blades (6,7) mounted between a floor plate (1,11) and a ceiling plate (2,12) which are radially symmetrical about a turbine shaft, the pitch of the blades (6) of the stationary blade set (4) being $L_S$ at the ceiling plate (2) and $L_B$ at the floor plate (1) and the outlet angle of the stream of fluid from the stationary blade set (4) relative to the plane between said blade sets being $\alpha 1_S$ adjacent to the ceiling plate (2) and $\alpha 1_B$ adjacent to the floor plate (1), in which stage the distance between the turbine shaft and the surface of the ceiling plate (2) decreases from the inlet end of the stationary blade set (4) to the outlet end thereof where its value is $r_S$ then it in increases from the inlet end of the moving blade set (5) where its value is $r_S$ up to the outlet end of the moving blade set (5), characterized in that means (403,404) are provided to reduce the tangential static pressure gradient in the neighbourhood of the ceiling plate at the outlet end of the stationary blade set (204) by a factor $\lambda(\lambda > 1)$ and in that the curvature of the meridian line of the ceiling plate (2) of the stationary blade set (4) perpendicular to the plane between the blade sets is substantially equal to $$-\frac{\cot^2\alpha_{1S}}{r_S} - \frac{1}{\lambda} \frac{\cos\alpha_{1S}}{4L_S \sin^2\alpha_{1S}}$$

4. A turbine stage with a circular stationary blade set (104) followed by a circular moving blade set (105), each blade set having blades (106, 107) mounted between a floor plate and ceiling plate which are radially symmetrical about a turbine shaft, the pitch of the blades (106) of the stationary blade set (104) being $L_S$ at the ceiling plate (102) and $L_B$ at the floor plate (101, 101') and the outlet angle of the stream of fluid from the stationary blade set (104) relative to the plane between said blade sets (104) being $\alpha 1_S$ adjacent to the ceiling plate (102) and $\alpha 1_B$ adjacent to the floor plate (101, 101') in which stage the distance between the turbine shaft and the surface of the floor plate (101, 101') varies continously from the inlet side of the stationary blade set (104) to the outlet side of said stationary blade set (104) where it reaches an extreme value $r_B$ then varies continously in the opposite direction from the inlet of the moving blade set (105), characterized in that means (403, 404) are provided to reduce the tangential static pressure gradient in the neighbourhood of the floor plate at the outlet end of the stationary blade set (204) by a factor $\lambda(\lambda' > 1)$ and in that the curvature of the meridian line of the floor plate (101, 101') of the stationary blade set (104) perpendicular to the plane between the blade sets is substantially equal to the difference $$\frac{1}{\lambda'} \cdot \frac{\cos\alpha_{1B}}{4L_B \sin^2\alpha_{1B}} - \frac{\cot^2\alpha_{1B}}{r_B}$$

the extreme value $r_B$ being a minimum when the difference is negative and a maximum when the difference is positive.

5. A turbine stage according to any one of claims 2 or 4, characterized in that the distance between the turbine shaft and the surface of the floor plate (1, 11) varies in a curve which has a maximum or a minimum as the case may be at the inlet end of the stationary blade set (4) and at the outlet end of the moving blade set (5) and a respective minimum or maximum in the plane between the blade sets.

6. A turbine stage according to any one of claims 1 or 3, characterized in that the distance between the turbine shaft and the surface of the ceiling plate (302) of the stationary blade set (304) varies in a curve which has a maximum at the inlet end of the stationary blade set (304) and a minimum in the plane between the blade sets while the distance between the turbine shaft and the surface of the ceiling plate (312) of the moving blade set (305) increases linearly from the minimum in the plane between the blade sets.

* * * * *